US008001729B2

(12) United States Patent
Joly, Jr. et al.

(10) Patent No.: US 8,001,729 B2
(45) Date of Patent: Aug. 23, 2011

(54) GUTTER COVER INSTALLATION

(76) Inventors: Robert E. Joly, Jr., South Rockwood, MI (US); Terry Claypool, New Boston, MI (US)

( * ) Notice: Subject to any disclaimer, the term of this patent is extended or adjusted under 35 U.S.C. 154(b) by 202 days.

(21) Appl. No.: 12/383,455

(22) Filed: Mar. 24, 2009

(65) Prior Publication Data

US 2010/0071273 A1 Mar. 25, 2010

Related U.S. Application Data

(60) Provisional application No. 61/192,837, filed on Sep. 22, 2008.

(51) Int. Cl.
*E04D 13/076* (2006.01)

(52) U.S. Cl. ..... 52/12; 52/11; 52/13; 248/48.1

(58) Field of Classification Search ..... 52/11, 12, 52/13; 248/48.1
See application file for complete search history.

(56) References Cited

U.S. PATENT DOCUMENTS

| | | | | |
|---|---|---|---|---|
| 2,271,081 | A | 1/1942 | Layton | |
| 2,583,422 | A | 1/1952 | Haddon | |
| 3,388,555 | A | 6/1968 | Foster | |
| 4,254,595 | A * | 3/1981 | Crosslen | 52/11 |
| 4,351,134 | A | 9/1982 | Clarkson | |
| 4,553,356 | A | 11/1985 | Pepper | |
| 4,631,875 | A | 12/1986 | Olson | |
| 4,727,689 | A * | 3/1988 | Bosler | 52/12 |
| 4,912,888 | A | 4/1990 | Martin | |
| 4,937,986 | A * | 7/1990 | Way et al. | 52/12 |
| 4,959,932 | A * | 10/1990 | Pfeifer | 52/12 |
| 5,459,965 | A * | 10/1995 | Meckstroth | 52/12 |
| 5,566,513 | A | 10/1996 | Herren | |
| 6,151,836 | A | 11/2000 | McGlothlin et al. | |
| 6,151,837 | A | 11/2000 | Ealer, Sr. | |
| 6,393,770 | B1 * | 5/2002 | Groom | 52/12 |
| 6,427,388 | B1 | 8/2002 | Brochu | |
| 6,786,008 | B2 | 9/2004 | Brochu | |
| 6,944,992 | B2 | 9/2005 | Brochu | |
| 7,143,549 | B2 | 12/2006 | Brochu | |
| 7,614,185 | B2 * | 11/2009 | Brochu | 52/11 |
| 7,891,142 | B1 * | 2/2011 | Ealer, Sr. | 52/12 |
| 2003/0009951 | A1 * | 1/2003 | Bergeron | 52/12 |
| 2003/0110712 | A1 | 6/2003 | Brochu | |

(Continued)

FOREIGN PATENT DOCUMENTS

| | | |
|---|---|---|
| CA | 2332485 | 7/2002 |
| CA | 2405756 | 3/2004 |

(Continued)

*Primary Examiner* — Brian E Glessner
*Assistant Examiner* — Rodney Mintz
(74) *Attorney, Agent, or Firm* — John R. Benefiel

(57) ABSTRACT

A gutter cover installation for covering a roof eave gutter to prevent debris from entering the gutter includes a main portion of the gutter cover formed with a pattern of openings and an outer edge of the outer side of the gutter cover projecting out and down past an outer wall of the gutter to form a diverter preventing overflow from flowing over the outer surface of the gutter outer wall and thereby avoid staining the same. The gutter cover inner side is held up by segments formed on the inner side of the cover forming a channel which projects down below the main portion and is engaged with a mounting bracket installed within the gutter to be supported thereby. An elastomeric sealing strip is inserted into the channel and projects up and back into engagement with a drip edge or fascia installed at the roof eave.

4 Claims, 2 Drawing Sheets

U.S. PATENT DOCUMENTS

| | | | | |
|---|---|---|---|---|
| 2005/0204642 | A1 | 9/2005 | Valentini | |
| 2005/0274081 | A1 | 12/2005 | Welty | |
| 2005/0274082 | A1 | 12/2005 | Welty | |
| 2006/0196124 | A1* | 9/2006 | Bachman | 52/12 |
| 2006/0201068 | A1* | 9/2006 | Shane | 52/11 |
| 2007/0214731 | A1* | 9/2007 | Bachman et al. | 52/12 |
| 2009/0108144 | A1* | 4/2009 | Brochu | 248/48.1 |
| 2011/0041414 | A1* | 2/2011 | Bell | 52/12 |

FOREIGN PATENT DOCUMENTS

| | | |
|---|---|---|
| CA | 2457152 | 9/2004 |
| CA | 2364602 | 6/2005 |
| CA | 2541186 | 1/2006 |
| CA | 2347342 | 3/2006 |
| CA | 2521542 | 1/2007 |
| CA | 2533988 | 7/2007 |
| CA | 2537681 | 8/2007 |

* cited by examiner

GUTTER COVER INSTALLATION

CROSS REFERENCE TO RELATED APPLICATIONS

This application claims the benefit of U.S. provisional application No. 61/192,837 filed on Sep. 22, 2008.

BACKGROUND OF THE INVENTION

This invention relates to covers for roof eave gutters. Debris such as twigs and leaves tends to get washed into the gutters and collect to the point of clogging the flow of rainwater. Covers or guards have come into common use which are designed to prevent the entrance of debris while allowing penetration of rainwater into the gutters thereby to reduce the problem of clogged gutters.

Numerous patents have issued on such gutter covers, which generally take the form of a slotted, perforated or grid like piece of sheet metal or plastic installed over the top of the gutter.

In addition, curved solid covers terminating just short of the outer edge of the gutter have been used, the curvature creating a flow of rainwater tending to project the debris over the outer edge of the gutter while the rainwater follows the curvature of the cover to pass into the gutter.

None of the gutter covers used heretofore have completely solved the problem in all conditions, as clogging and overflow can still occur.

In a design shown in U.S. Pat. Nos. 4,553,356 and 6,944,992, a flexible lip is mounted along the inner edge of the cover engaged with a building fascia or drip edge to seal the gutter against rainwater overflow behind the gutter. In many designs a sealing flange or strip is extended up beneath the shingles as also seen in U.S. Pat. No. 6,944,992.

The lack of any support beneath the inner side of the cover will allow it to drop down creating a reverse tilt tending to impound rainwater, which can cause accumulation of debris.

The gutter cover shown therein has perforations allowing drainage into the gutter, but such perforations limit the inflow of rainwater into the gutter and can easily overflow in heavy rain.

For this reason, a dam feature is provided at the outer edge to impound the rainwater which is said to increase the flow of rainwater through the perforations and into the gutter. Such dam can be ineffective to prevent overflow and can also cause accumulation of debris on the surface of the cover, defeating the purpose of the gutter cover by blocking the perforations and thus cause overflow of the rainwater over the edge of the cover and gutter.

Such overflow can cause unsightly "tiger striping" on the outer wall of the gutter caused by dark discolorations as the rainwater laden with decayed organic material flows down the outside surface of the outer wall of the gutter.

This is a particular problem with light colored gutters.

To prevent this from happening, there has heretofore been devised a diverter for preventing rain overflow from flowing down the outer surface of the gutter outside wall. Such a diverter is described in Canadian patent no. 2,537,681, which comprises either a clip-on separate diverter piece or a gutter integrally formed with a lip projecting past the front wall of the gutter so that overflow is directed past the gutter and prevented from running down the exposed outer surface of the gutter outer wall.

This approach requires either the manufacture and installation of a separate diverter piece or a specially shaped gutter.

It is an object of the present invention to provide a cover for roof eave gutters which improves the performance of gutter covers of the type having a flexible sealing strip on the inner side of the gutter cover.

It is a further object of the present intention to reduce the tendency for "tiger striping" on the outside of the gutter outer wall to occur without requiring a separate diverter piece or special gutter shape.

SUMMARY OF THE INVENTION

The above recited objects and other objects which will be understood upon a reading of the following specification and claims are achieved by a gutter cover comprised of a generally planar main portion formed with an array of openings allowing drainage into the gutter. The openings may comprise slots preferably formed by punching curving lips into the main cover portion which slope down into the gutter interior to direct water through the gutter cover into the gutter. The inner side of the cover is formed with a channel downwardly extending from the main portion and created by a reverse bends of the cover creating a downward extending first segment and a return second segment extending back up to form an angled channel lying below the cover main portion.

The bottom of this channel may rest atop a gutter mounting bracket when installed so that the inner side of the cover is supported to remain elevated to prevent impoundment of water and allows a slight elevation to induce flow down across the cover to assist in carrying any debris away and off the surface of the cover main portion.

The angled channel has inserted therein a flexible strip of an elastomeric material preferably of SANTOPRENE (trademark) which has a long life in exposed environments such as to retain its flexibility and sealing ability.

The sealing strip is inclined by the angle of the channel and extends up and back to engage a drip edge or other adjacent surface, preventing rainwater from passing behind the gutter cover and gutter.

The front or outer side of the gutter cover is formed with a reverse bend at its outer side forming a generally flattened U-shaped outer edge. A reversely bent lip is formed at the end of a bottom leg of the flattened U-shape edge creating a flared pocket which is pressed against the formed upper edge of the gutter outer wall, capturing to secure the gutter cover outer side to the gutter outer edge.

A series of sheet metal screws secure the outer side of the cover to the top of the gutter outer wall on which it rests.

An important feature of the present invention is the extension of the flattened U-shape outside edge of the gutter cover substantially beyond the gutter outer wall formed upper edge and also formed to have a downward angle. This downward angled projecting edge creates a diverter surface which is integrated into the gutter cover, which diverter surface carries off overflow water past the gutter to prevent water flow from descend down the outer surface of the outer wall of the gutter. This is achieved without the use of a separate diverter piece or a special gutter shape.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
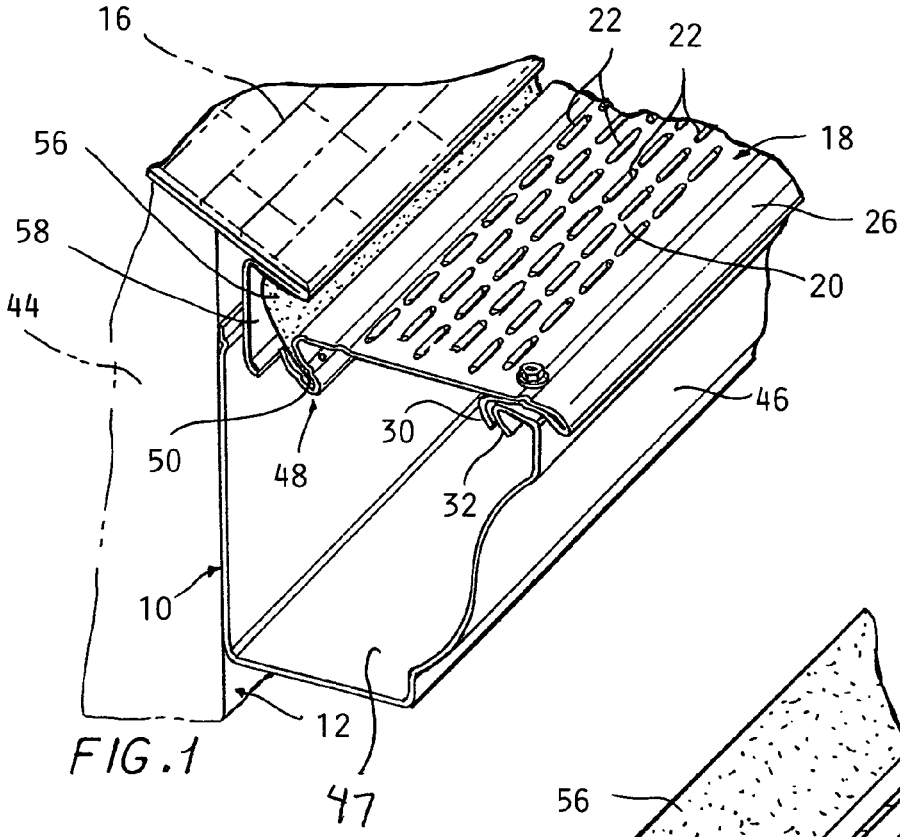
FIG. 1 is a pictorial fragmentary view of a gutter installed on a roof eave with a gutter cover according to the present invention installed thereon.

Referring to the drawings, FIG. 1 shows a roof eave gutter 10 having an outer wall 46, and inner wall 45, and a bottom wall 47 defining a gutter space for receiving rainwater drainage from the shingled roof 16. The gutter 10 is secured to a building wall 12 by a mounting bracket 14 (FIG. 3) below the shingled roof 16 so as to collect rainwater draining therefrom. A gutter cover 18 according to the present invention is installed so as to overlie the top of the gutter 10.

The gutter cover 18 has a generally planar main portion 20 formed with openings allowing rainwater to pass through and into the gutter 10. The openings are preferably staggered rows of slots 22.

Figure 4A:
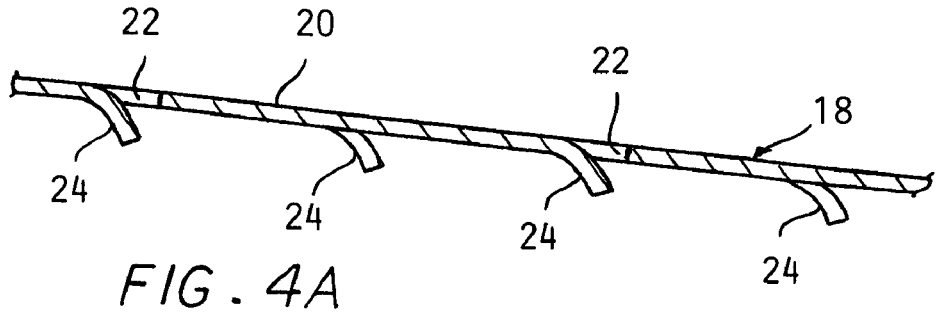
FIG. 4A is a further enlarged fragmentary sectional view through a main portion of the gutter cover.
Figure 4B:
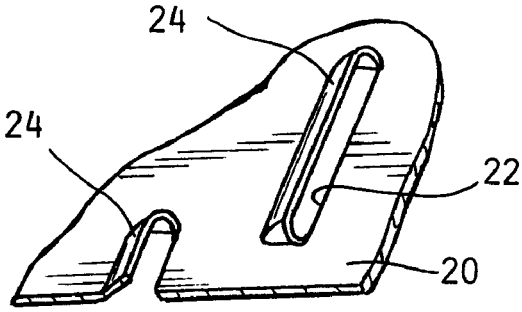
FIG. 4B is a pictorial view of the fragmentary gutter cover portion shown in FIG. 4A.

As best seen in FIGS. 4A and 4B the slots 22 preferably comprise lips 24 punched into the cover 18 and downwardly inclined to maximize the flow of rainwater into the gutter 10 by the tendency of the flow to follow the curved lips 24. Such slot features are shown in U.S. Pat. Nos. 3,380,555 and 2,271,081.

The outer side of the gutter cover 18 is formed with a flattened U-shaped end portion 26, which extends onto the formed top 33 of the gutter outer wall 46 in which a lower segment 28 extends back beneath the generally planar main portion 20 of the gutter cover 18, with a terminal portion 30 folded down and back forwardly to form a generally V-shaped feature which is placed against the V-shaped inside edge 32 of the top of the outer wall 46 of the gutter 10.

Sheet metal screws are driven through the edge 26 and into the top of the gutter outer wall top 33 to secure the gutter cover 18 in position.

Figure 3:
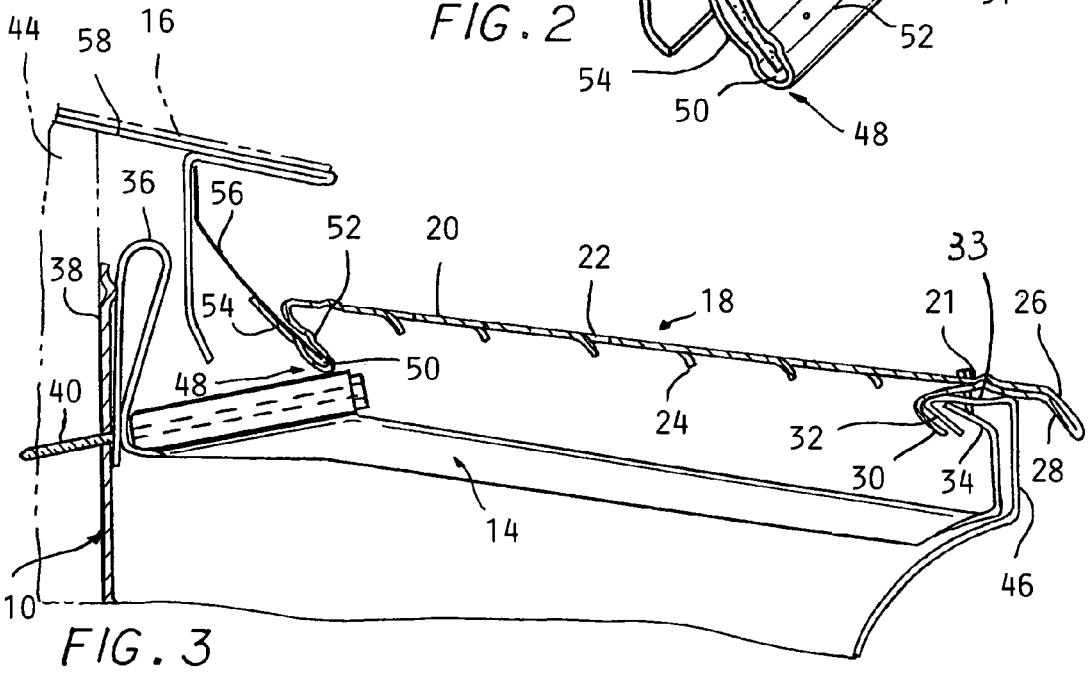
FIG. 3 is a further enlarged fragmentary view of a section through upper regions of the gutter, gutter cover, and adjacent building portions shown in FIG. 1

The mounting bracket 14 has an outer edge 34 received within the formed top edge 32 of the gutter outer wall 46 (FIG. 3). The folded inner end 36 abuts the rear wall 38 of the gutter 10 with a screw 40 received in a U-shaped screw guide 42 formed into the bracket 14 and driven through the rear wall 45 of the gutter 10 and into a fascia board 44. Such brackets 14 are well known and a series of them would be installed along the length of the gutter 10 in the well known manner.

According to one feature of the invention, the outer edge 26 of the gutter cover 18 may optionally project well beyond the gutter outer wall top 33 and is angled down as shown. This forms a diverter or drip edge integral with the cover so that any rainwater overflow off the main portion 20 of the cover 18 does not run down the outer surface of the outer wall 46 of the gutter 10.

Figure 2:
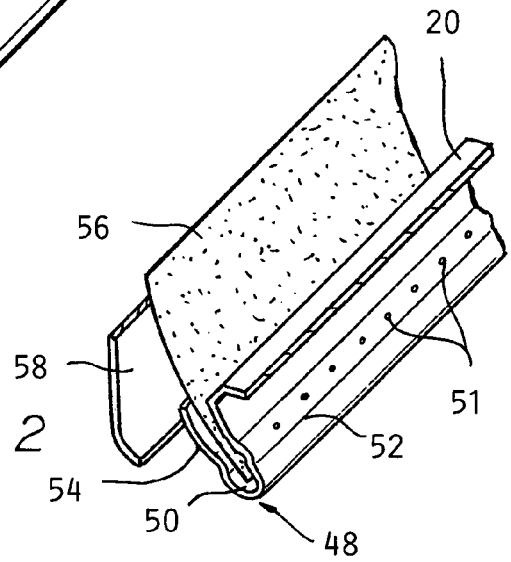
FIG. 2 is enlarged pictorial view of a portion of a rear side of the gutter cover with a fragmentary portion of a drip edge engaged with a flexible sealing strip forming a portion of a gutter cover according to the invention.

The inner side 48 of the cover 18 has a channel 50 formed by a downward and forwardly angled segment 52 and an upwardly and rearwardly angled segment 54 defining the channel 50 therebetween. A flexible sealing strip 56 is inserted therein, where it may be retained by a series of rolled in stitches 51 in a well known manner (FIG. 2).

The sealing strip 56 is made from an elastomeric material and the thermoplastic elastomeric SANTOPRENE (trademark) is preferred for this purpose as it weathers well to retain its elastic properties.

The sealing strip 56 is of a sufficient width to be compressed against a drip edge 58 normally installed beneath the shingles 16 as indicated in FIGS. 1 and 3.

As seen in FIG. 3, the inner edge 48 extends down below the cover main portion 20 and rests on the mounting bracket 14 so as to provide a vertical support for the inner side 48 of the gutter 10 maintaining the inner side of the gutter cover 18 level, or even creating a shallow downward inclination of the main portion 20 extending towards the outer gutter wall 46, such that any rainwater overflow will tend to wash off debris to prevent accumulation thereof. The use of staggered rows of slots 22 with the curved lips 24 maximizes the flow of rainwater into the gutter 10 such that the overflow of rainwater is minimal.

Figure 5:
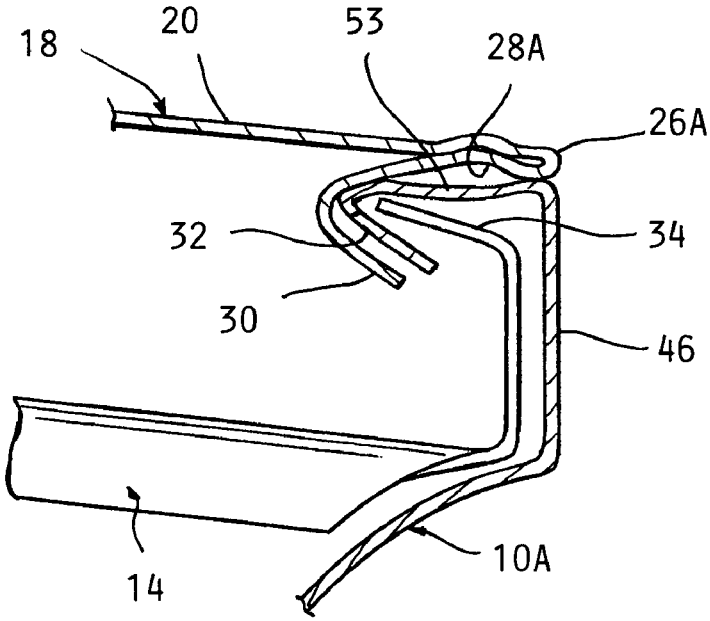
FIG. 5 is an enlarged sectional view of a modified portion of the gutter cover shown in FIGS. 1-3.

As seen in FIG. 5, the outer edge 26A can be shortened to not project beyond the gutter edge 32 if a dark colored gutter 10A is used.

The invention claimed is:

1. A gutter cover combined with a roof eave gutter having an upright outer wall having a formed top, an inner wall, and a bottom wall defining an open topped gutter space for receiving rainwater draining from the roof, said gutter adapted to be secured to a building by a bracket extending between said outer wall and said inner gutter wall, said bracket having opposite ends secured to said gutter outer and inner walls respectively, said gutter cover extending over the open top of said gutter and including a generally planar main portion overlying said gutter and formed with openings allowing rainwater to pass through said gutter cover main portion and into said gutter space, an outer side of said cover extending out and onto the formed top of the outer wall of said gutter to be supported thereby; said gutter cover also including an inner side adjacent said inner wall of said gutter formed with an angled channel defined by a first segment of said gutter cover angled outwardly and downwardly, extending below said gutter cover main portion and a return segment extending back up along said first segment to define said angled channel lying below said main portion; a bottom of said downwardly extending segments engaged with said bracket to maintain said gutter cover inner side elevated above said bracket and the top of the gutter outer wall to slope said main portion downward toward said gutter outer wall; an elastomeric strip inserted in said angled channel extending up and away from said cover main portion and engaging a surface fixed of said building to prevent rainwater from passing into said gutter space without passing through said gutter cover openings.

2. The combination according to claim 1 wherein said outer side of said gutter cover is formed with an edge thereof further projecting over and substantially beyond said top of said gutter outer wall and angled downwardly to form a diverter drip edge feature carrying rainwater runoff from said gutter cover away from an outer surface of said gutter front wall.

3. The combination according to claim 2 wherein said top of said gutter outer wall includes an inner V-shaped edge and an outer side of said gutter cover includes a segment folded back under said gutter cover to form a flattened U-shaped edge, extending back past said top of said gutter outer wall, and further formed with a downwardly and reversely projecting edge at the end of said segment forming a V-shaped feature pressed against said top of said V-shaped edge of said gutter outer wall to be engaged therewith.

4. The combination according to claim 3 wherein a series of sheet metal screws are driven through said gutter cover outer side and into a flat surface of said top of said gutter outer wall.

* * * * *